United States Patent [19]

Brana et al.

[11] 4,071,655

[45] Jan. 31, 1978

[54] TREATED FERROMAGNETIC CARRIER PARTICLES FOR DEVELOPMENT POWDERS

[75] Inventors: George Brana, Bridgeport, Conn.; Bheema Rao Vijayendran, Berkley Heights, N.J.

[73] Assignee: Pitney-Bowes, Inc., Stamford, Conn.

[21] Appl. No.: 752,363

[22] Filed: Dec. 20, 1976

[51] Int. Cl.[2] ..... G03G 9/10; G03G 9/14

[52] U.S. Cl. ..... 428/403; 96/1 SD; 252/62.1 P; 260/29.6 SQ; 260/42.14; 252/62.53; 252/62.54; 427/215; 427/216; 427/221; 427/388 R; 427/18; 428/407

[58] Field of Search ..... 252/62.1 P, 62.54, 62.53; 96/1 SD; 428/403, 404, 406, 407; 427/215, 216, 221, 388 R, 18; 260/29.6 SQ, 42.14

[56] References Cited

U.S. PATENT DOCUMENTS

| | | | |
|---|---|---|---|
| 2,718,514 | 9/1955 | Fantl | 260/29.6 SQ |
| 2,728,740 | 12/1955 | Iler | 260/42.14 |
| 2,971,947 | 2/1961 | Floria et al. | 260/29.6 SQ |
| 3,206,445 | 9/1965 | Volk | 260/29.6 SQ |
| 3,718,594 | 2/1973 | Miller | 252/62.1 P |
| 3,764,310 | 10/1973 | Hagenbach | 252/62.1 P |
| 3,811,880 | 5/1974 | Browning | 252/62.1 P |
| 3,884,871 | 5/1975 | Herman et al. | 260/42.14 |
| 3,922,381 | 11/1975 | Datta | 252/62.1 P |
| 3,969,238 | 7/1976 | Tsuneda | 260/29.6 SQ |

*Primary Examiner*—Ralph S. Kendall
*Assistant Examiner*—John D. Smith
*Attorney, Agent, or Firm*—Peter Urahotes; William D. Soltow, Jr.; Albert W. Scribner

[57] ABSTRACT

Carrier particles of development powders are treated with a sodium salt of polystyrene sulfonic acid. As a result of the treatment, the triboelectric properties of the carrier particles are better controlled.

7 Claims, No Drawings

TREATED FERROMAGNETIC CARRIER PARTICLES FOR DEVELOPMENT POWDERS

BACKGROUND OF THE INVENTION

With the increased use of plain paper copiers, development powders have enjoyed an advancing popularity over liquid toners. Along with the advancing use of development powders, magnetic brush units are becoming increasingly popular as opposed to cascading methods. Development powders used with magnetic brush units usually have an iron powder which serves as the carrier material. Inexpensive, untreated iron powders cannot be used in magnetic brush systems since such iron does not have sufficient stability toward rusting and has color and triboelectric charging properties adversely effected by variable humidity conditions. In order to solve the problem, those in the art have resorted to chemical plating and coating of the iron particles with polymers, oils, waxes and the like and various treatments. For example, U.S. pat. No. 3,922,381 discloses a method for applying a perfluoro acid to the surface of an electrophotographic carrier particle. Another method of treating iron particles is disclosed in U.S. Pat. Nos. 3,632,512 and 3,718,594, where the carrier particles are exposed to an aqueous acid solution, washed, then coated with a continuous film. Belgian Pat. No. 746,109 also discloses a process fo treating carrier method with an acid-wash.

Although many treatments are effective to reduce the tendency to rust, such treatments have not been completely successful in enhancing the triboelectric properties of the carrier particles. Untreated iron carrier particles when mixed with a standard toner are known to have a charge to mass ratio (C/M) of approximately 7 $\times 10^{-6}$ coul/gm. It has been found that the perfluoro acid treatment of the iron carrier particles disclosed in U.S. Pat. No. 3,922,381 has increased the C/M to a range of $13 \times 10^{-6}$ to $17 \times 10^{-6}$ coul/gm. It would be desirable to be able to increase the C/M further as an increasing C/M leads to increasingly sharper contrast and lower background in electrophotographic copies.

SUMMARY OF THE INVENTION

In the art of electrostatographic imaging process, an electrostatic latent image is formed on a recording surface of a photoconductor. The electrostatic image may then be developed by finely-divided toner particles electrostatically attached to the surface of carrier particles. Preferably, the carrier particles are iron powder or beads.

It has been found that treating the iron powder with a solution of the sodium salt of polystyrene sulfonic acid produces a carrier particle which has a high triboelectric charge when mixed with a standard toner. This treatment results in the carrier particles having a C/M of $24 \times 10^{-6}$ to $36 \times 10^{-6}$ coul/gm.

By using the treated carrier particles of this invention, an improved electrophotographic copy is obtained in that the copy has sharp contrast and low background as a result of the high C/M of the carrier particles.

DESCRIPTION OF THE PREFERRED EMBODIMENT

The core of the carrier particle formed by the present invention may be any material which can react chemically with the sodium salts of polystyrene sulfonic acid of this invention. Thus, by way of example, the material of the core of the carrier particle may be sand, glass beads, metallic beads of metallic powders. As used in this specification, including the appended claims, the term metal and metallic is intended to include elemental metals as well as their oxides, carbides and other forms of metallic compounds and alloys which have a solid form.

The core of carrier particles of the preferred embodiment is a ferromagnetic material such as iron or steel. Other suitable ferromagnetic materials such as magnetic oxides and alloys of copper-nickel-iron, for example, also may be employed. The size of the core may be between 40 and 1000 microns with the preferred size range being between 50 and 400 microns.

The sodium salts of polystyrene sulfonic acid should have a minimum molecular weight of 50,000 and is represented by the structure:

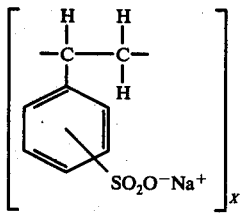

when X is greater than 240

An example of a commercially available sodium salt of polystyrene is VERSA-TL available from National Starch and Chemical Corp.

In a typical process for treating iron powder with the sodium salts of polystyrene sulfonic acid, the sulfonic acid is dissolved in a suitable solvent such as either distilled or deionized water and alcohol to form a solution and iron powder is subsequently added thereto. The iron powder should be added in a proportion of up to 500 gms of iron and 100cc of solution. The solvent must be highly acidic and should have a pH of less than 2.5, the preferable range being 2.0 to 2.5. It has been found necessary to add another acid such as HCl in order to increase the acidity. Although any suitable acid may be used, it is believed that an inorganic acid would be preferable. The mixture may then be rolled in any known fashion and subsequently decanted. Following this, the iron powders may be washed with the deionized water and thereafter washed with a cleaning substance such as methanol. Obviously, the iron powder may be washed with alcohol but this would be expensive. In order to prevent rusting of the carrier particle, an additive such as a hydrazene sulfate may be added to the methanol. Following the rinsing steps, the powder may then be dried and passed through a screen, such as a 70 mesh screen, to break-up any agglomerates. The materials resulting from this treatment were tested and a high increase in the charge mass ratio was noted. The following examples will serve to highlight the method of treating iron powders according to the instant invention.

EXAMPLE I

A quantity of 0.596 gms. of Versa TL-71 was diluted with 100cc deionized water to form a solution. A drop of HCl was added to bring the pH to 2.2. To a quantity of 25cc of the above solution 100 gr of −100 mesh iron powder was added and mixed for 20 minutes on rollers. The supernatant was removed. The remainder was washed with deionized water repeatedly, then dried in an oven at 80° centigrade. A 2.4% concentration development powder was prepared using an epoxy resin toner with the above treated iron. The resulting C/M was $20.4 \times 10^{-6}$ coul/gm.

EXAMPLE II

A quantity of 2.3gms Versa TL-71 was diluted with 50cc methanol to form a solution. To 25cc of this solution, 100 grams of −100 mesh iron powder was added. The resulting combination was mixed for 20 minutes on rollers, after which the supernatant was removed. The mixture was then washed with methanol repeatedly. Following this washing the particles were dried in an oven at 80° centigrade. A 2.4% development powder concentration was prepared using the treated iron with an epoxy resin toner. A C/M of $26.6 \times 10^{-6}$ was achieved.

What is claimed is:

1. A ferromagnetic carrier particle for use in electrophotographic development of latent images capable of inducing an electrostatic charge in a toner mixed therewith the surface of which has been treated with a sodium salt of polystyrene sulfonic acid having a minimum molecular weight of 50,000, said treated particle having a charge to mass ratio of $24 \times 10^{-6}$ to $36 \times 10^{-6}$ coul/gm.

2. The carrier particle of claim 1 wherein said member is iron having a particle size of 50 to 400 microns.

3. In a method of treating ferromagnetic carrier particles for development powders, the combination comprising:

A. adding a quantity of the sodium salts of polystyrene sulfonic acid to a solvent to produce a 10–80% solution of said sulfonic acid salt to solvent;

B. adding a second acid to said solution to obtain a pH of 2.0 to 2.5;

C. placing the carrier particles having a particle size of 50 to 400 microns into the solution in the proportion of up to 500 grams of particles per 100 cc of solution to form a mixture;

D. rolling the mixture;

E. decanting the excess solution from the mixture;

F. washing the carrier particles; and

G. drying the carrier particles.

4. The method of claim 3 wherein the carrier particles are washed with alcohol after decanting the excess solution.

5. The method of claim 4 including the step of adding hydrazine sulfate to the alcohol.

6. The method of claim 4 wherein said solvent is water.

7. The method of claim 4 wherein said solvent is alcohol.

* * * * *